US005934252A

United States Patent [19]

Hafner et al.

[11] Patent Number: 5,934,252

[45] Date of Patent: Aug. 10, 1999

[54] FUEL INJECTION SYSTEM

[75] Inventors: Udo Hafner, Ludwigsburg; Eckhard Bodenhausen, Steinheim; Thomas Gregorius, Grossbottwar; Thomas Naeger, Offenburg; Thomas Raff, Ludwigsburg; Albert Staacke, Steinheim, all of Germany

[73] Assignee: Robert Bosch GmbH, Stuttgart, Germany

[21] Appl. No.: 08/913,183

[22] PCT Filed: Oct. 11, 1996

[86] PCT No.: PCT/DE96/01939

§ 371 Date: Dec. 18, 1997

§ 102(e) Date: Dec. 18, 1997

[87] PCT Pub. No.: WO97/25529

PCT Pub. Date: Jul. 17, 1997

[30] Foreign Application Priority Data

Jan. 8, 1996 [DE] Germany ..... 196 00 378

[51] Int. Cl.[6] ..... F02M 55/02

[52] U.S. Cl. ..... 123/468

[58] Field of Search ..... 123/470, 445, 123/468, 469, 472, 184.61

[56] References Cited

U.S. PATENT DOCUMENTS

| | | | |
|---|---|---|---|
| 4,563,984 | 1/1986 | Ziegler et al. . | |
| 5,097,594 | 3/1992 | Daly et al. | 29/888.01 |
| 5,150,842 | 9/1992 | Hickey | 239/585.4 |
| 5,156,124 | 10/1992 | Sugimoto et al. | 123/470 |
| 5,189,782 | 3/1993 | Hickey | 123/470 |
| 5,419,297 | 5/1995 | Peterson, Jr. et al. | 123/470 |
| 5,568,798 | 10/1996 | Lorraine | 123/456 |

FOREIGN PATENT DOCUMENTS

| | | |
|---|---|---|
| 0 139 122 | 5/1985 | European Pat. Off. . |
| 0 501 612 | 9/1992 | European Pat. Off. . |

*Primary Examiner*—Andrew M. Dolinar
*Assistant Examiner*—Arnold Castro
*Attorney, Agent, or Firm*—Kenyon & Kenyon

[57] ABSTRACT

A fuel injection system includes a substantial integration of various components, the fuel injection system including at least one fuel injector and at least one intake manifold, as well as a fuel supply channel, which are all surrounded by a plastic sheathing. The full integration of the fuel injectors into an induction pipe component made of plastic leads to the reduction or elimination of both electrical and hydraulic interfaces. Thus, only a compact component remains that is very simple to attach to a cylinder head of an internal combustion engine. Means for electrically contacting the fuel injectors (1), such as connector sockets, are also fully integrated in the plastic sheathing. This fuel injection system is especially suited for use in mixture-compressing internal combustion engines having externally supplied ignition.

14 Claims, 2 Drawing Sheets

FUEL INJECTION SYSTEM

FIELD OF THE INVENTION

The present invention related to a fuel injection system.

BACKGROUND INFORMATION

European Patent Application No. 0 139 122 describes a fuel injection system that is able to be mounted on the cylinder head of an internal combustion engine. This fuel injection system comprises a plurality of intake lines that open into an elastic connecting tube element, which isolates structure-borne noise and is configured, in turn, with a flange on its cylinder-head side, a fixed connection to the cylinder head being realized with the flange. The elastic connecting tube element, which is preferably made of an elastomeric plastic, thus, partially accommodates the intake lines and, in addition, has a sleeve-shaped mount for a fuel injector (injection valve). The mount and connecting tube element form one piece which surrounds the fuel injector in its installed position over nearly its entire extent. The fuel injection system, thus, has a multipart design, the complete fuel injector being installed in the mount, which thus forms a holding means for it. In this context, the mount is so configured that the outer contour of the fuel injector is essentially closely fitted.

Unexamined European Patent Application 0 501 612, the fuel injection system having multipart intake manifolds with flanges at their ends for interconnecting them. The intake manifolds are manufactured either from aluminum or plastic and, in addition to their actual flow passages, have seating areas for fuel injectors. These seating areas each essentially surround a fuel injector with a radial clearance, since, e.g., the fuel is supplied via the seating areas to fuel injectors configured as "side-feed" injectors. The fuel injectors are first introduced in their fully assembled state into these seating areas. It is necessary for the fuel injector to be sealed off in the seating areas by at least two sealing rings.

SUMMARY OF THE INVENTION

An object of the present invention is to provide a fuel injection system whose components are integrated to an extreme degree. This creates a simplified design over the prior art and thereby obtains a significant cost advantage. By fully integrating the injection valves on an intake manifold or intake distributor made of plastic, both electrical, as well as hydraulic interfaces of the fuel injection system are reduced or even entirely eliminated. In addition, the advantageous elimination of connecting means and sealing means implies further savings in parts and thus in materials. The multiplicity of advantages obtained through full integration are listed, for example, as follows:

- Elimination of the actual plastic extrusion coating around the fuel injector.
- Elimination of a component for supply fuel (e.g., fuel distributor).
- Elimination of several connecting means (e.g., lock rings, screws and others).
- Elimination of various sealing means,(e.g., O-rings).
- Elimination of several installation steps because of the one-part configuration.

It is especially advantageous to integrate the electrical lines (e.g.,) used for the common electrical contacting of the fuel injectors, into the fuel distributor (e.g., used for supplying fuel to the fuel injectors). Only one central connector is then needed for the external electrical connection of the fuel injection system.

DETAILED DESCRIPTION OF THE INVENTION

Figure 1:
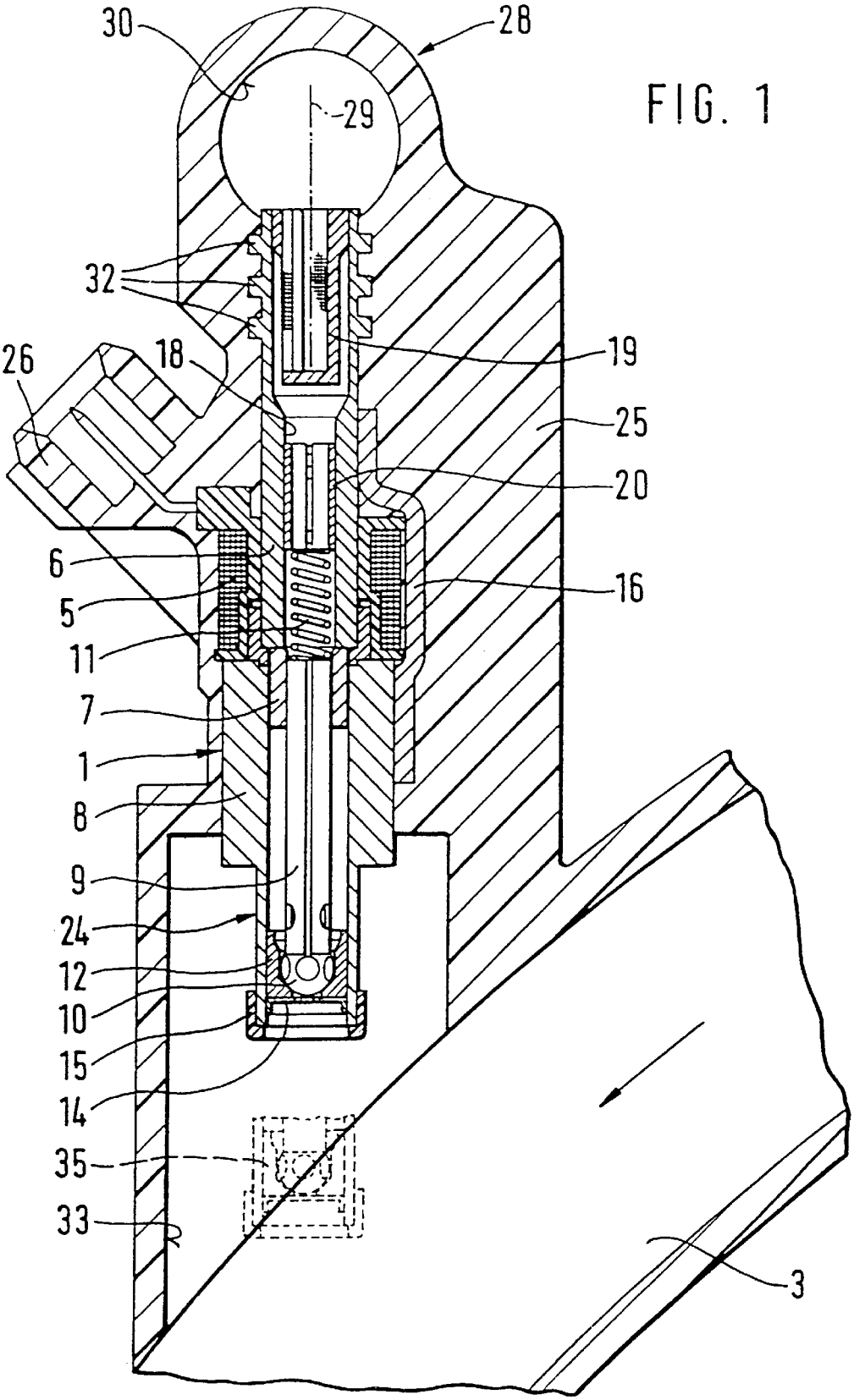
FIG. 1 shows a partial section through a fuel injection system according to an embodiment of the present invention.

FIG. 1 shows a partial section through a fuel injection system according to an embodiment of the present invention which comprises, inter alia, at least one fuel injector 1, the fuel injection system being used, in particular, as part of a fuel injection system of mixture-compressing internal combustion engines having externally supplied ignition. In FIG. 1, only one fuel injector 1 is shown in section, in conjunction with an intake manifold 3 that is configured as a single induction pipe 1 and leads to a combustion chamber (not shown) of the internal combustion engine. As a rule, however, the fuel injection system will be used in conjunction with an MPI (multipoint injection), where, for example, each combustion chamber of the internal combustion engine is assigned its own fuel injector 1. Thus, in an internal combustion engine having four combustion chambers (4-cylinder engine), for example, four intake manifolds 3 extend in the direction of the combustion chambers, each fuel injector 1 opening into an intake manifold 3. By way of intake manifold 3 having, for example, a circular cross-section, intake air or recirculated exhaust gas is made available to the internal combustion engine in the direction indicated by an arrow; the air quantity being controlled by means of a throttle element (not shown) upstream from the opening of fuel injector 1 into intake manifold 3.

Well suited for service in the fuel injection system of the invention are, for example, "top-feed" fuel injectors where the fuel is supplied by way of the end facing away from the intake manifold. A full description of the exemplary and simplified representation of fuel injector 1 will not be given here, since such a fuel injector is already well known from Unexamined German Application No. 43 25 842, which is hereby incorporated by reference, there being certain differences—of course, in the matter of plastic extrusion coating because of the design of the fuel injection system according to the invention. Other constructions of already known fuel injectors may also be used in the fuel injection system.

the Fuel injector 1 is actuated in the known manner e.g., electromagnetically. For that reason, fuel injector 1 has an electromagnetic circuit comprising, inter alia, a solenoid coil 5, a core 6 used both as a fuel intake fitting and an inner pole, and comprising an armature 7. Downstream from solenoid coil 5 extends a valve-seat carrier 8, which forms part of the housing of fuel injector 1. Arranged in tubular valve-seat carrier 8 is a valve needle 9, which at its upstream end is fixedly connected to armature 7 and, at its downstream end, is fixedly connected to a valve-closure member 10. The electromagnetic circuit is used to axially move valve needle 9 and, thus, to open the injector against the resistance of a return spring 11 and to close it. Imperviously mounted in the end of valve-seat carrier 8 facing away from core 6 is a valve-seat member 12, which has a fixed valve seat, with which valve-closure member 10 cooperates, in turn.

The fuel to be spray-discharged is metered, e.g., through a pot-shaped spray-orifice plate 14-which is fixedly connected to valve-seat member 12 and has at least one, e.g., four spray orifices formed by erosive machining or punching. Disposed at the immediate downstream end of valve-seat carrier 8 is, for example, a protective cap 15. Solenoid coil 5 is surrounded by at least one conductive element 16, configured as a clip and used as a ferromagnetic element, which at least partially surrounds solenoid coil 5 in the circumferential direction, abuts with its two ends on core 6 or on valve-seat carrier 8, and is securely joined thereto. Provision is made in a flow-through bore 18 of core 6, e.g., for a fuel filter 19 for filtering out fuel components that could cause blockage, and for an adjustment sleeve 20 for adjusting the resilience of return spring 11.

The fuel injector 1 according to an embodiment of the present invention, is not, as previously known, surrounded by an injection-molded plastic housing to form a component that can be installed in a mount of a fuel injection system, but rather is directly integrated into the fuel injection system as described according to the present invention. Except for a small downstream region 24 of fuel injector 1, fuel injector 1 is completely surrounded by plastic sheathing, the plastic sheathing 25 being formed in one piece with intake manifolds 3 so as to form a compact fuel injection system and, thus, is also produced in a single plastic injection-molding process. The plastic sheathing 25 may also include, for example, an integral injection molded electrical connector 26 for each fuel injector 1.

In addition, a fuel distributor 28 is also provided directly within the fuel injection system, the fuel distributor also being directly co-formed by plastic sheathing 25 of fuel injector 1. In this context, during the injection molding process, the injection-molding die includes an injection-molding core located immediately above the inflow-side end of fuel injector 1 and transversely to longitudinal valve axes 29 of fuel injectors 1. Following removal of said core, a fuel supply channel 30 is formed for fuel injectors 1 within plastic sheathing 25. The fuel supply channel 30 that is open toward each flow-through bore 18 has, for example, a circular cross-section, the plastic forming the wall of fuel supply channel 30 being provided with a substantially constant wall thickness. The wall thickness of plastic sheathing 25 may vary along the axial extent of fuel injector 1 to accommodate installation requirements.

Fuel injectors 1 are adjusted prior to being extrusion-coated. In this context, the insertion depth of valve-seat member 12 within the valve-seat carrier 8 determines the magnitude of the lift of valve needle 9. When solenoid coil 5 is not energized, one end position of valve needle 9 is determined by the position of valve-closure member 10 on the seat of valve seat member 12; when solenoid coil 5 is excited, the other end position of valve needle 9 is determined by the fitting (e.g., seating ) of armature 7 on core 6. The spring tension of valve needle 9 that is braced against return spring 11 is, as already mentioned, set by adjustment sleeve 20. Solenoid coil 5 is sealed from fuel supply channel 30 by means, for example, of a plurality of ribs 32 concentrically disposed around the periphery of core 6 near fuel distributor 28, the rings 32 forming a "labyrinth seal". Alternatively, an ordinary sealing ring installed on the periphery of core 6 could be co-extruded.

To economize on plastic, downstream area 24 of fuel injector 1 is configured as an exposed (open) area i.e., valve-seat carrier 8 is not enclosed by any plastic there. Rather, the area 24 protrudes into a side-opening 33 of intake manifold 3, which has, for example, a circular cross-section. In this context, fuel injector 1 is, for example, so aligned that the fuel to be spray-discharged impinges essentially directly at an inlet valve (not shown) in the cylinder head of the internal combustion engine. It is also conceivable to design fuel injector 1 in a lengthened configuration and, by this means, allow it to project fully through side opening 33, the injection end of fuel injector 1 extending up to inside intake manifold 3, as indicated by the dotted lines.

Figure 2:
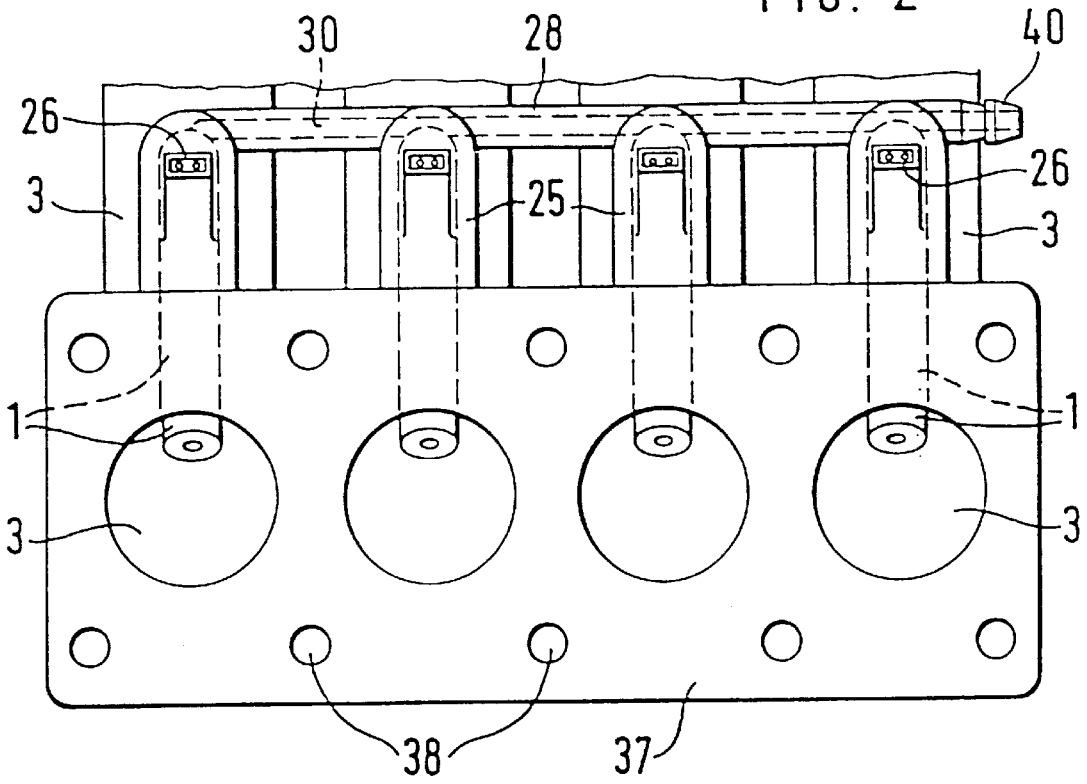
FIG. 2 shows a fuel injection system, configured for installation on the cylinder head of an internal combustion engine, with fuel injectors having individual connectors according to an embodiment of the present invention.
Figure 3:
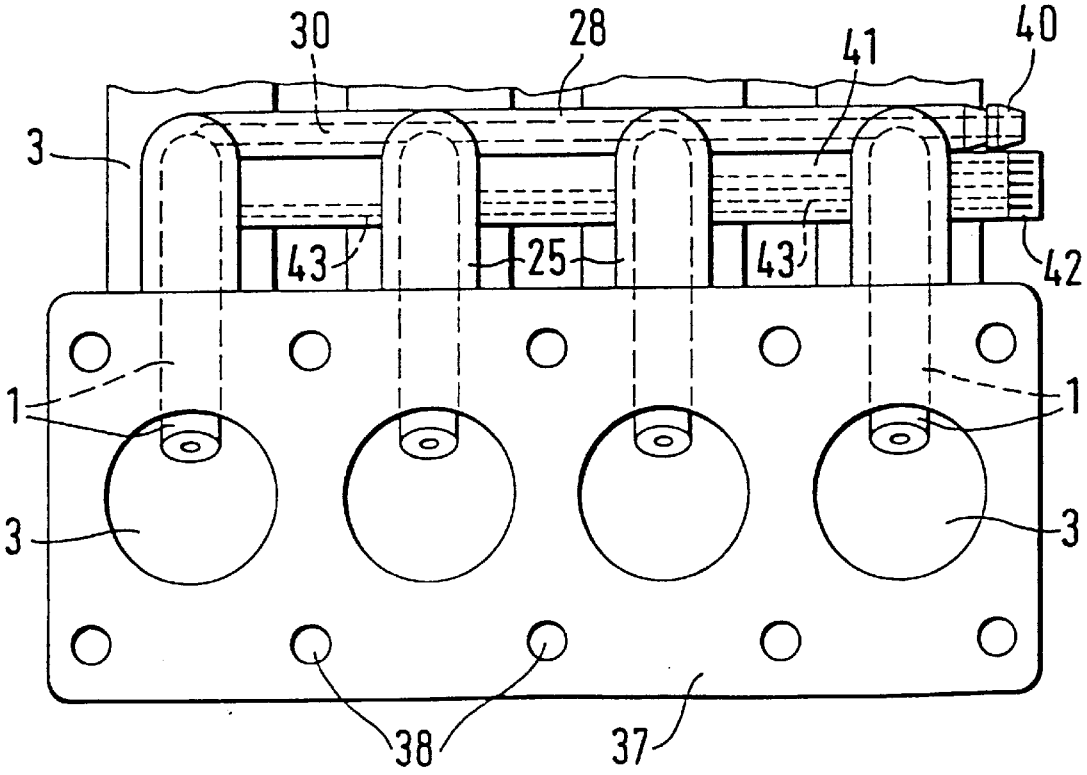
FIG. 3 shows a fuel injection system, configured for installation on the cylinder head of an internal combustion engine, having a central connector according to an embodiment of the present invention.

FIGS. 2 and 3 show schematic exemplary embodiments of the fuel injection system according to the present invention as a compact component for installation on the cylinder head of an internal combustion engine. Intake manifolds 3 terminate at a mounting flange 37 which, for example, has a plurality of openings 38 into which means for mounting the fuel injection system to the cylinder head may be inserted. The individual fuel injectors 1 are, in the embodiment shown in FIG. 2, contacted separately from one another, i.e., each fuel injector 1 has its own plug connector 26 which may have the form represented in FIG. 1. Intake manifolds 3 run as induction runners separately, at least in the described fuel injection system, and together form an induction pipe assembly. Fuel distributor 28 extends with its inner fuel supply channel 30 along all fuel injectors 1, rendering possible a simultaneous supplying of fuel to all fuel injectors 1. At its one end, fuel distributor 28 has a connecting means 40. In this context, connecting means 40 is designed, for example, in the form of a connection pipe fitting to which a fuel supply hose (not shown) can be attached, or it can form a "quick-connector", which enables bayonet-type quick connections to be achieved.

FIG. 3 shows an exemplary embodiment of the fuel injection system according to the present invention where the electrical contacting of individual fuel injectors 1 is carried out by way of a contact bar 41 that interconnects all fuel injectors 1. Contact bar 41, which is provided directly at the time of injection molding of the fuel injection system, and thus is completely extrusion-coated with plastic, has at its one end a central connector 42 which, e.g., has a five-pin design given four fuel injectors 1 to be contacted. With every fuel injector 1, the number of electrical lines 43 provided in contact bar 41 decreases by one up to that fuel injector 1 which is the most remote from central connector 42 and to which two electrical lines 43 still lead. Contact bar 41 and fuel distributor 28 are not shown to scale in FIG. 3 and do not need to run separately next to one another or above and below one another. It is, rather, advantageous to integrate electrical lines 43 directly in or on fuel distributor 28 so that there will only be one plastic connecting piece running transversely to fuel injectors 1.

What is claimed is:

1. A fuel injection system for an internal combustion engine, comprising:

at least one fuel injector coated with a plastic injection-molded coating; and at least one intake manifold cooperating with the at least one fuel injector, wherein the plastic injection-molded coating forms a fuel supply channel disposed adjacent to the at least one fuel injector, a wall of the at least one intake manifold also being formed integral with the plastic injection-molded coating.

2. The fuel injection system as defined by claim 1, wherein the plastic injection-molded coating includes a mounting flange at which the at least one intake manifold terminates, the mounting flange being mounted to a cylinder head of the internal combustion engine.

3. The fuel injection system as defined by claim 1, wherein the at least one fuel injector includes at least two fuel injectors and the at least one intake manifold includes at least two intake manifolds, each of the at least two fuel injectors being assigned to a respective one of the at least two intake manifolds, each of the at least two intake manifolds being configured separately from another intake manifold.

4. The fuel injection system as defined by claim 1, wherein the at least one fuel injector includes at least two fuel injectors, each fuel injector having a longitudinal valve axis, the fuel supply channel running transversely to the longitudinal valve axes of the at least two fuel injectors, the fuel supply channel and the plastic injection-molded coating forming the fuel supply channel forming a fuel distributor which proceeds directly from the plastic injection-molded coating surrounding the at least two fuel injectors.

5. The fuel injection system as defined by claim 1, wherein each of the at least one fuel injectors includes a unitary electrical connector integrally formed with the plastic injection-molded coating.

6. The fuel injection system as defined by claim 1, wherein each of the at least two fuel injectors is connected to an electrical line of a contact bar, the contact bar being formed integral with the plastic injection-molded coating and terminating with a central connector, the electrical contacting of each of the at least one fuel injectors being accomplished via the electrical line of the contact bar.

7. The fuel injection system as defined by claim 4, wherein each of the at least two fuel injectors is connected to an electrical line of a contact bar, the contact bar being formed integral with the plastic injection-molded coating and terminating with a central connector, the electrical contacting of each of the at least one fuel injectors being accomplished via the electrical line of the contact bar and wherein the electrical line is integrated in the fuel distributor.

8. The fuel injection system as defined by claim 1, wherein the at least one fuel injector includes a core forming a fuel intake fitting and an inner pole which forms an inflow-side end of the at least one fuel injector facing the fuel-supply channel, an outer periphery of the core having a plurality of concentrically disposed, annular ribs enclosed by the plastic injection-molded coating.

9. The fuel injection system as defined by claim 10, wherein a downstream end region of the at least one fuel injector faces the at least one intake manifold, the downstream end region being separated from the plastic injection-molded coating and extending into a side opening of the at least one intake manifold.

10. The fuel injection system as defined by claim 1, wherein an upper end region of the at least one fuel injector receives fuel and is substantially enclosed by the plastic injection-molded coating.

11. The fuel injection system as defined by claim 10, wherein the fuel supply channel is situated at a top end of the upper end region of the at least one fuel injector.

12. The fuel injection system as defined by claim 1, wherein the at least one fuel injector is maintained in the plastic injection-molded coating without using a lock ring.

13. The fuel injection system as defined by claim 1, wherein the at least one fuel injector is a top-feed type injector.

14. The fuel injection system as defined by claim 1, wherein the plastic injection-molded coating contacts a substantial portion of the at least one fuel injector.

* * * * *